US010203715B2

(12) United States Patent
Liou

(10) Patent No.: US 10,203,715 B2
(45) Date of Patent: Feb. 12, 2019

(54) BANDGAP REFERENCE CIRCUIT FOR PROVIDING A STABLE REFERENCE VOLTAGE AT A LOWER VOLTAGE LEVEL

(71) Applicant: ELITE SEMICONDUCTOR MEMORY TECHNOLOGY INC., Hsinchu (TW)

(72) Inventor: Jian-Sing Liou, Jiangsu (CN)

(73) Assignee: ELITE SEMICONDUCTOR MEMORY TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/220,709

(22) Filed: Jul. 27, 2016

(65) Prior Publication Data

US 2018/0032097 A1 Feb. 1, 2018

(51) Int. Cl.
*G05F 3/30* (2006.01)
*G05F 3/26* (2006.01)

(52) U.S. Cl.
CPC ..... *G05F 3/262* (2013.01); *G05F 3/30* (2013.01)

(58) Field of Classification Search
None
See application file for complete search history.

(56) References Cited

U.S. PATENT DOCUMENTS

| | | | | |
|---|---|---|---|---|
| 6,906,581 | B2 * | 6/2005 | Kang | G05F 3/30 323/313 |
| 7,570,107 | B2 * | 8/2009 | Kim | G05F 3/30 323/313 |
| 2008/0224682 | A1 * | 9/2008 | Haiplik | G05F 3/30 323/313 |
| 2009/0243713 | A1 * | 10/2009 | Marinca | G05F 3/30 327/542 |
| 2011/0169561 | A1 * | 7/2011 | Chu | G05F 3/30 327/539 |
| 2012/0153997 | A1 * | 6/2012 | Blanc | G05F 3/30 327/109 |
| 2014/0117967 | A1 * | 5/2014 | Mitsuishi | G05F 3/30 323/313 |

* cited by examiner

*Primary Examiner* — Jeffrey A Gblende
(74) *Attorney, Agent, or Firm* — Juan Carlos A. Marquez; Marquez IP Law Office, PLLC

(57) ABSTRACT

A bandgap reference circuit incorporates first, second, and third current sources, first and second amplifiers, first and second bipolar transistors, a feedback device, a first resistor, and a second resistor. The first resistor is coupled between one input of the second amplifier and the base of the first bipolar transistor. The second resistor is coupled between the base of the first bipolar transistor and the base of the second bipolar transistor. The first and second amplifies and the first to third current sources constitute negative feedback loops which force the voltages at the inputs of the amplifiers to be substantially equal.

13 Claims, 5 Drawing Sheets

BANDGAP REFERENCE CIRCUIT FOR PROVIDING A STABLE REFERENCE VOLTAGE AT A LOWER VOLTAGE LEVEL

BACKGROUND OF THE INVENTION

1. Field of the Invention

The present invention generally relates to reference circuits, and more specifically to a bandgap reference circuit.

2. Description of the Related Art

A bandgap reference circuit is used to generate a precise and a stable output voltage. The generated voltage is independent of process, voltage, and temperature. The bandgap reference circuit is widely used in various analog and digital circuits that require a precise voltage for operation.

FIG. 1 illustrates one commonly used bandgap reference circuit 100. Referring to FIG. 1, the bandgap reference circuit 100 includes PMOS transistors M1, M2, and M3, an operational amplifier OP, resistors R1 and R2, and bipolar transistors Q1, Q2, and Q3. If the base current is neglected, the output voltage VOUT of the bandgap reference circuit 100 can be expressed as:

$$VOUT = VEB3 + VT \times \ln N \times \left(\frac{R2}{R1}\right) \tag{1}$$

Where VEB3 is the emitter-base voltage of the bipolar transistor Q3, VT is the thermal voltage at room temperature, and N is the ratio of the emitter areas of the bipolar transistor Q2 to the emitter areas of the bipolar transistor Q1.

As can be seen from the equation (1), by adjusting the resistance ratio of resistors R2 to R1, the conventional bandgap reference circuit 100 can provide a stable reference voltage VOUT having a zero temperature coefficient. The voltage level of the voltage VOUT is at around 1.25V, which is approximately equal to the silicon energy gap measured in electron volts, i.e., the silicon bandgap voltage.

However, in order to meet the application requirements of different integrated circuits, a reference voltage with a substantially zero temperature coefficient at different voltage levels is needed.

SUMMARY OF THE INVENTION

One aspect of the present invention is a bandgap reference circuit that provides a reference voltage and a reference current.

According to one embodiment of the present invention, the bandgap reference circuit comprises first, second, and third current sources, first and second amplifiers, first and second bipolar transistors, a feedback device, a first resistor, and a second resistor. The first amplifier has a first input, a second input, and a first output. The second amplifier has a third input, a fourth input, and a second output. The first current source is coupled between a power supply node and the first input of the first amplifier. The second current source is coupled between the power supply node and the second input of the first amplifier. The third current source is coupled between the power supply node and the third input of the second amplifier. The first bipolar transistor has a base, an emitter coupled to the first current source, and a collector coupled to a ground node. The second bipolar transistor has a base, an emitter coupled to the second current source, and a collector coupled to the ground node. The first resistor is coupled between the third input of the second amplifier and the base of the first bipolar transistor. The feedback device is coupled between the third current source and the base of the second bipolar transistor and the first feedback device is controlled by the second output of the second amplifier. The second resistor is coupled between the base of the first bipolar transistor and the base of the second bipolar transistor. The fourth input of the second amplifier is coupled to one of the first input of the first amplifier and the second input of the first amplifier.

BRIEF DESCRIPTION OF THE DRAWINGS

The invention will be described according to the appended drawings in which.

DETAILED DESCRIPTION OF THE INVENTION

Figure 2:
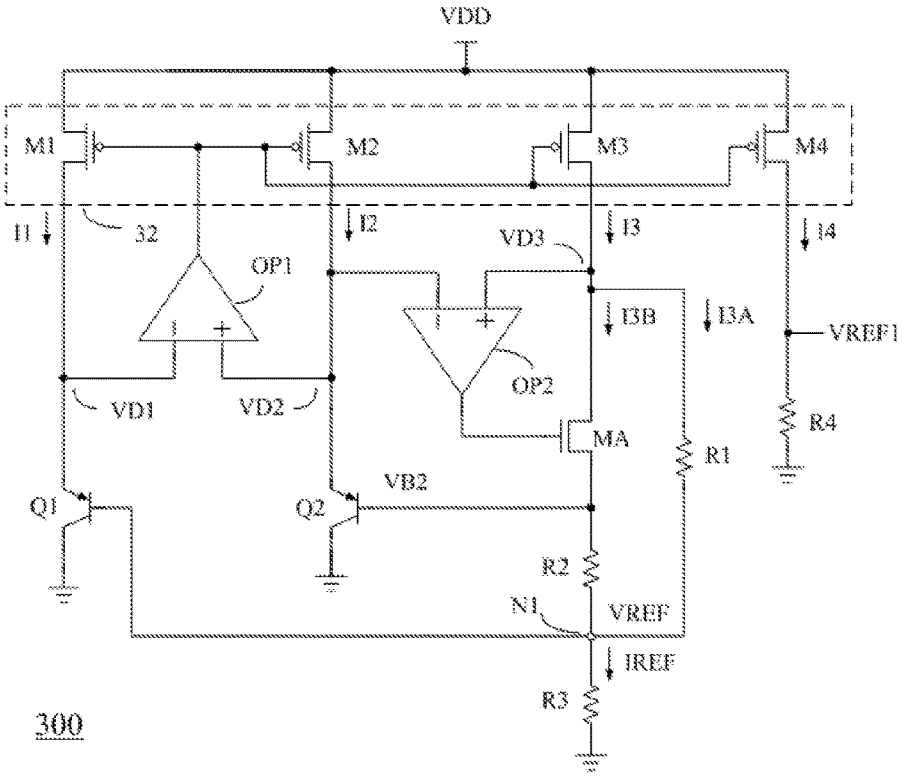
FIG. 2 shows a schematic diagram of a bandgap reference circuit according to a first embodiment of the present invention.

FIG. 2 shows a schematic diagram of a bandgap reference circuit 200 according to one embodiment of the present invention. Referring to FIG. 2, the bandgap reference circuit 200 comprises a current source unit 22, an operational amplifier OP1, an operational amplifier OP2, a bipolar transistor Q1, a bipolar transistor Q2, a feedback transistor MA, a resistor R1, and a resistor R2.

The current source unit 22 provides a plurality of stable bias currents I1, I2, and I3. In this embodiment, the current source unit 22 is a current mirror formed by a plurality of PMOS transistors M1, M2, and M3. Referring to FIG. 2, the PMOS transistor M1 has a source coupled to a supply voltage VDD, a gate coupled to an output of the operational amplifier OP1, and a drain coupled to an inverting input of the operational amplifier OP1. The PMOS transistor M2 has a source coupled to the supply voltage VDD, a gate coupled to the output of the operational amplifier OP1, and a drain coupled to a non-inverting input of the operational amplifier OP1 and an inverting input of the operational amplifier OP2. The PMOS transistor M3 has a source coupled to the supply voltage VDD, a gate coupled to the output of the operational amplifier OP1, and a drain coupled to a non-inverting input of the operational amplifier OP2.

The bipolar transistor Q1 has a base, an emitter coupled to the inverting input of the operational amplifier OP1, and a collector coupled to a ground node. The bipolar transistor Q2 has a base, an emitter coupled to the non-inverting input of the operational amplifier OP1 and the inverting input of the operational amplifier OP2, and a collector coupled to the ground node.

Referring to FIG. 2, the feedback transistor MA is a NMOS transistor having a drain coupled to the non-inverting input of the operational amplifier OP2, a gate coupled to an output of the operational amplifier OP2, and a source coupled to the base of the bipolar transistor Q2. The resistor R1 is connected between the non-inverting input of the operational amplifier OP2 and the base of the bipolar transistor Q1. The resistor R2 is coupled between the base of the bipolar transistor Q1 and the base of the bipolar transistor Q2.

Referring to FIG. 2, the operational amplifier OP1 and the current source unit 22 constitute a first negative feedback loop which forces the voltages VD1 and VD2 to be substantially equal. The operational amplifier OP2, the feedback transistor MA, and the current source unit 22 constitute a second negative feedback loop which forces the voltages VD2 and VD3 to be substantially equal.

Since the gates of the PMOS transistors M1, M2, and M3 are connected to each other, the sources of the PMOS transistors M1, M2, and M3 are connected to the common supply voltage VDD, and the voltages at the drains of the PMOS transistors M1, M2, and M3 are substantially equal, the currents I1, I2, and I3 flowing through the PMOS transistors M1, M2, and M3 are proportional to the W/L ratio of the transistors.

Referring to FIG. 2, the voltages VD1 and VD3 can be expressed as:

$$VD1=VREF+VEB1=VD3=VREF+I3A\times R1 \quad (2)$$

VREF is a summed voltage at a summing node N1. VEB1 is the emitter-base voltage of the bipolar transistor Q1, and I3A is the current flowing through the resistor R1.

Thus, equation (2) can rearranged into the following equation (3):

$$I3A = \frac{VEB1}{R1} \quad (3)$$

Since the emitter-base voltage of the bipolar transistor Q1 is nearly complementary to absolute temperature (i.e., a CTAT voltage), the current I3A is a CTAT current.

By ignoring the base currents of the bipolar transistors Q1 and Q2, voltages VD1 and VD2 can be expressed as:

$$VD1=VREF+VEB1=VD2=VREF+I3B\times R2+VEB2 \quad (4)$$

VEB2 is the emitter-base voltage of the bipolar transistor Q2, and I3B is the current flowing through the resistor R2.

Thus, equation (4) can rearranged into the following equation (5):

$$I3B = \frac{(VEB1 - VEB2)}{R2} = \frac{\Delta VBE}{R2} \quad (5)$$

Since the voltage difference ΔVBE is proportional to an absolute temperature (i.e., a PTAT voltage), the current I3B is a PTAT current.

Referring to FIG. 2, one CTAT current I3A flowing through R1 is summed with one PTAT current I3B flowing through R2 at the summing node N1 (ignoring the base currents of the bipolar transistors Q1 and Q2). Therefore, the bandgap reference circuit 200 can provide a stable output current IREF having a zero temperature coefficient by adjusting the value of the resistor R1 and the value of the resistor R2. The bandgap reference circuit 200 can also provide the stable output current IREF having a desired temperature coefficient by adjusting the value of the resistor R1 and the value of the resistor R2. For example, the positive temperature coefficient of the output current IREF is obtained by decreasing the value of the resistor R2, and the negative temperature coefficient of the output current IREF is obtained by decreasing the value of the resistor R1. In order to mirror the current IREF, a PMOS transistor M4 is added in the current source unit 22. Since the amount of the output current IREF current is substantially equal to that of the current flowing through the PMOS transistor M3 (ignoring the base currents of the bipolar transistors Q1 and Q2 and the input currents of the operational amplifier OP2), the PMOS transistor M4 provides an output current I4 proportional to the W/L ratio of the transistors.

Figure 3:
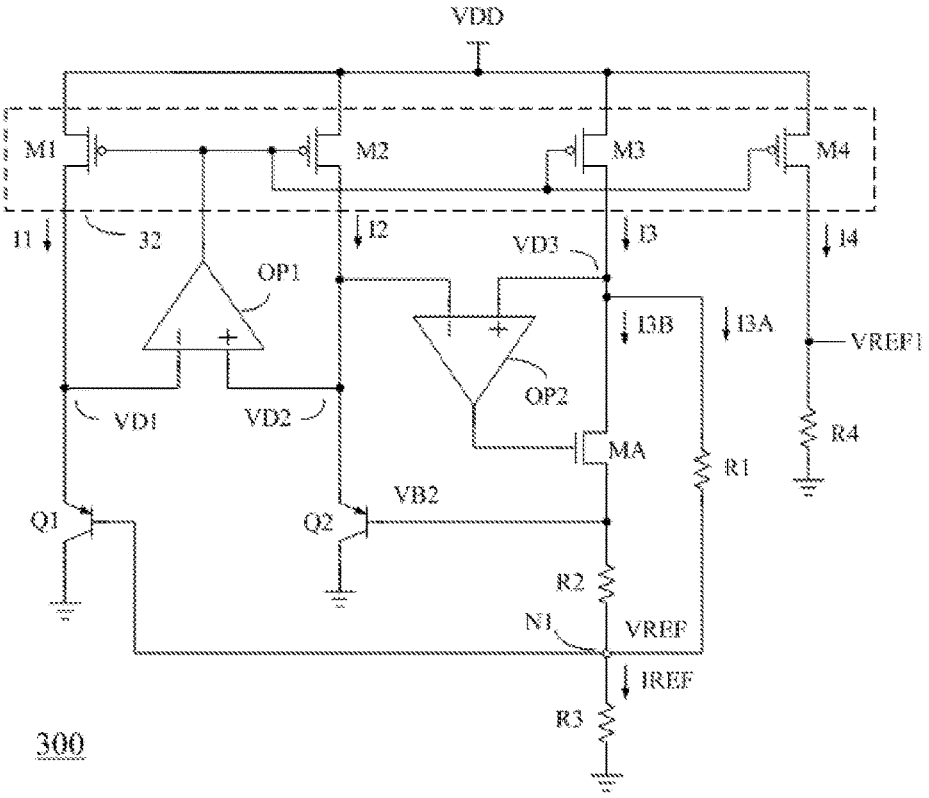
FIG. 3 shows a schematic diagram of a bandgap reference circuit for a second embodiment of the present invention.
Figure 4:
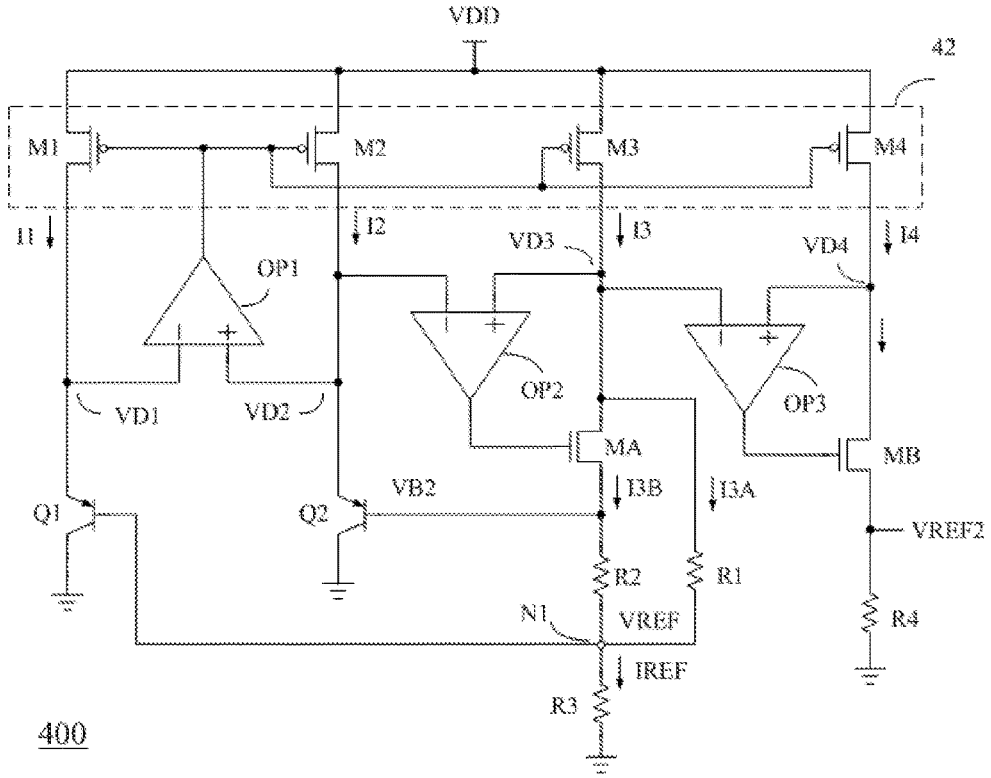
FIG. 4 shows a schematic diagram of a bandgap reference circuit for a third embodiment of the present invention.

Referring to FIG. 3, a resistor R3 is coupled between the summing node N1 and the ground node. Therefore, the stable reference voltage VREF is obtained at the summing node N1. A resistor R4 is coupled between the drain of the PMOS transistor M4 and the ground node. Therefore, the other stable reference voltage VREF1 is obtained. In order to provide the more precise current I4, an operational amplifier OP3 and a feedback transistor MB are added in FIG. 4. The operational amplifier OP3, the feedback transistor MB, and the current source unit 42 constitute a third negative feedback loop which forces the voltages VD3 and VD4 to be substantially equal.

Figure 1:
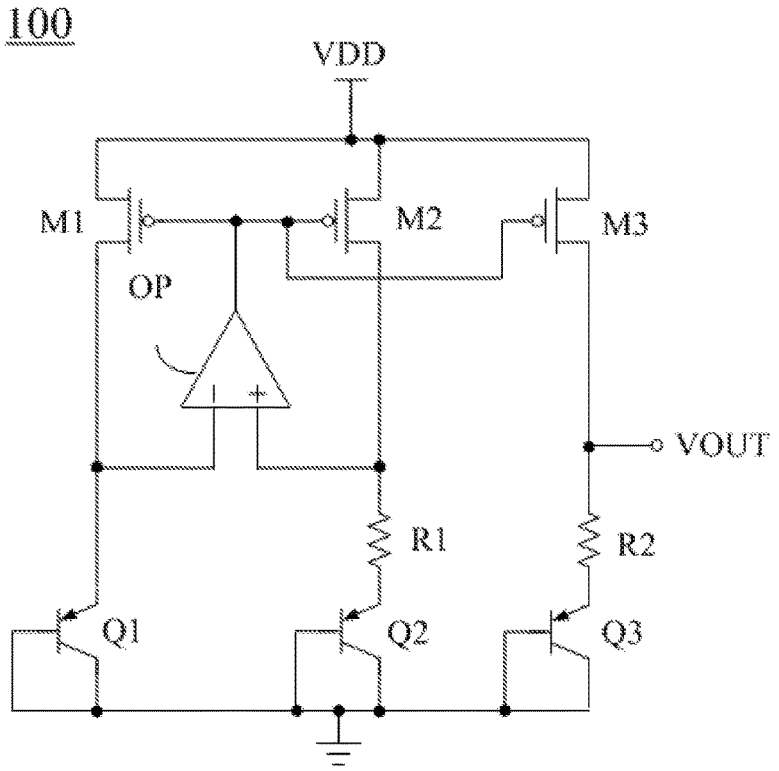
FIG. 1 illustrates one commonly used bandgap reference circuit.

Compared with the prior art, the bandgap reference circuit 300 of FIG. 3 can provide the stable reference voltage VREF1 at a lower voltage level (e.g., less than about 0.6V) since the resistor R4 is directly connected to the ground node, rather than the bipolar transistor Q3 shown in FIG. 1. In addition, since the voltages VD1, VD2 and VD3 are substantially equal and the gates of the PMOS transistors M1, M2, M3, and M4 are connected to each other, the PMOS transistors M1, M2, M3, and M4 can be biased at the saturation region or at the linear region to provide proportional currents which are proportional to the W/L ratio of the transistors. With such circuit configuration, the bandgap reference circuit 300 of the invention can provide the output voltage VREF1 in a wide voltage range from 0V to VDD-VSD,M4 depending on the value of the resistor R4, wherein VSD,M4 is the source-drain voltage of the PMOS transistor M4. That is, the output voltage VREF1 can be close to the supply voltage VDD.

Figure 5:
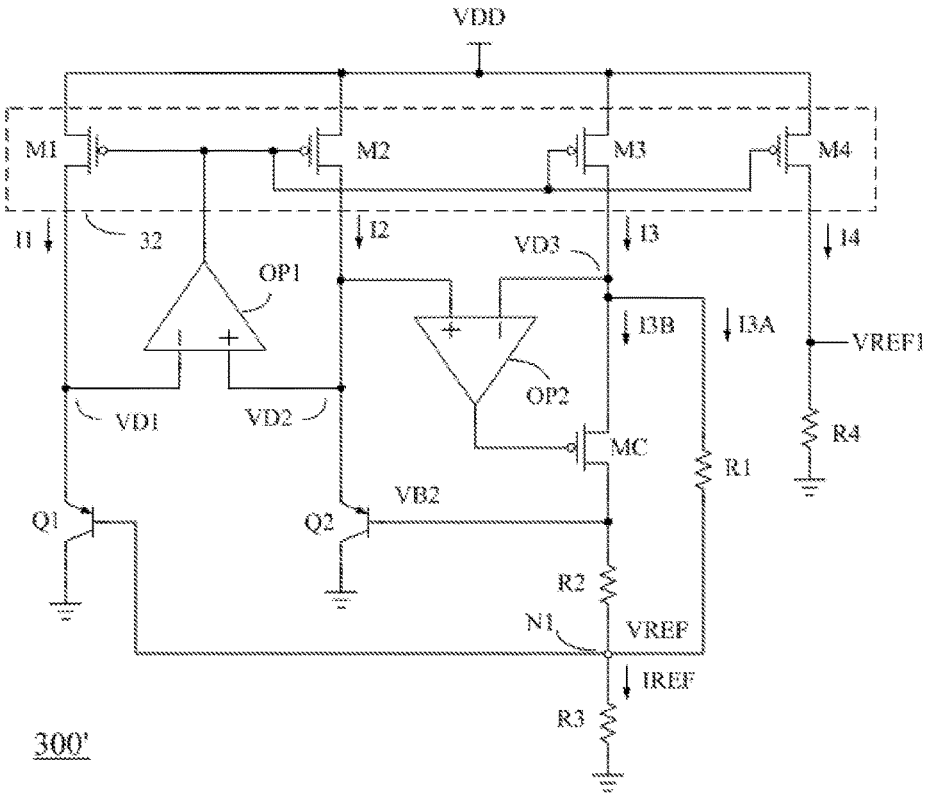
FIG. 5 shows a schematic diagram of a bandgap reference circuit for a fourth embodiment of the present invention.

Referring to FIG. 3, the operational amplifier OP1, the operational amplifier OP2, and the feedback transistor MA maintain the voltages VD1, VD2 and VD3 at substantially equal voltages by negative feedback. However, it should be obvious that the present invention is not limited to this configuration. For example, the inverting input of the operational amplifier OP2 can receive the voltage VD1 rather than the voltage VD2 in FIG. 2. In another embodiment of the present invention, a feedback transistor MC is a PMOS transistor as shown in FIG. 5. The non-inverting input of the operational amplifier OP2 receives the voltage VD2, and the inverting input of the operational amplifier OP2 receives the voltage VD3. In yet another embodiment of the present invention, the non-inverting input of the operational amplifier OP2 receives the voltage VD1 rather than the voltage VD2 in FIG. 5. With such circuit configurations, the voltages VD1, VD2 and VD3 are substantially equal.

The above-described embodiments of the present invention are intended to be illustrative only. Numerous alternative embodiments may be devised by those skilled in the art without departing from the spirit and scope of the invention as recited in the following claims.

What is claimed is:

1. A bandgap reference circuit, comprising:

a first amplifier having a first input, a second input, and a first output;

a second amplifier having a third input, a fourth input, and a second output;

a first current source coupled between a power supply node and the first input of the first amplifier;

a second current source coupled between the power supply node and the second input of the first amplifier;

a third current source coupled between the power supply node and the third input of the second amplifier;

a first bipolar transistor having a base, an emitter coupled to the first current source, and a collector coupled to a ground node;

a second bipolar transistor having a base, an emitter coupled to the second current source, and a collector coupled to the ground node;

a first resistor coupled between the third input of the second amplifier and the base of the first bipolar transistor;

a first feedback device coupled between the third current source and the base of the second bipolar transistor, the first feedback device being controlled by the second output of the second amplifier; and a second resistor coupled between the base of the first bipolar transistor and the base of the second bipolar transistor;

wherein the fourth input of the second amplifier is coupled to one of the first input of the first amplifier and the second input of the first amplifier;

wherein a current flowing through the first resistor is a complimentary to an absolute temperature (CTAT) current; and wherein a current flowing through the second resistor is a proportional to an absolute temperature (PTAT) current.

2. The bandgap reference circuit of claim 1, further comprising a third resistor coupled between the base of the first bipolar transistor and the ground node.

3. The bandgap reference circuit of claim 1, further comprising a fourth current source coupled to the power supply node and configured to mirror the current flowing through the third current source.

4. The bandgap reference circuit of claim 3, further comprising a fourth resistor coupled between the fourth current source and the ground node.

5. The bandgap reference circuit of claim 2, further comprising a voltage generating unit, wherein the voltage generating unit consists of a fifth current source and a fifth resistor, wherein the fifth current source is coupled to the power supply node and is configured to mirror the current flowing through the third current source, and the fifth resistor is coupled between the fifth current source and the ground node.

6. The bandgap reference circuit of claim 4, further comprising:

a third amplifier having a fifth input coupled to the third current source, a sixth input coupled to fourth current source, and a third output; and a second feedback device coupled between the fourth current source and the fourth resistor, the second feedback device being controlled by the third output of the third amplifier.

7. The bandgap reference circuit of claim 5, further comprising:

a third amplifier having a fifth input coupled to the third current source, a sixth input coupled to fourth current source, and a third output; and a second feedback device coupled between the fifth current source and the fifth resistor, the second feedback device being controlled by the third output of the third amplifier.

8. The bandgap reference circuit of claim 1, wherein the current flowing through the first feedback transistor is summed with the current flowing through the first resistor to generate the current flowing through the third current source, and the positive temperature coefficient of the current flowing through the third current source is obtained by decreasing the value of the second resistor.

9. The bandgap reference circuit of claim 1, wherein the current flowing through the first feedback transistor is summed with the current flowing through the first resistor to generate the current flowing through the third current source, and the negative temperature coefficient of the current flowing through the third current source is obtained by decreasing the value of the first resistor.

10. The bandgap reference circuit of claim 2, wherein the current flowing through the first feedback transistor is summed with the current flowing through the first resistor to generate a reference voltage at a cross point of the second resistor and the third resistor, and the positive temperature coefficient of the reference voltage is obtained by decreasing the value of the second resistor.

11. The bandgap reference circuit of claim 2, wherein the current flowing through the first feedback transistor is summed with the current flowing through the first resistor to generate a reference voltage at a cross point of the second resistor and the third resistor, and the negative temperature coefficient of the reference voltage is obtained by decreasing the value of the first resistor.

12. The bandgap reference circuit of claim 5, wherein a reference voltage is generated at a cross point of the fifth current source and the fifth resistor, and the reference voltage is less than 0.6V.

13. The bandgap reference circuit of claim 5, wherein a reference voltage is generated at a cross point of the fifth current source and the fifth resistor, and the reference voltage is close to a voltage at the power supply node.

* * * * *